United States Patent [19]

Saucier

[11] 4,083,148

[45] Apr. 11, 1978

[54] WINDOW INSULATING APPARATUS

[76] Inventor: Ernest R. Saucier, 143 Merriam Ave., Leominster, Mass. 01543

[21] Appl. No.: 747,701

[22] Filed: Dec. 6, 1976

[51] Int. Cl.[2] ..... E05D 15/26

[52] U.S. Cl. ..... 49/125; 49/63; 49/458

[58] Field of Search ..... 49/125, 61, 63, 406, 49/458, 414, 422, 423, 433

[56] References Cited

U.S. PATENT DOCUMENTS

| | | | |
|---|---|---|---|
| 1,086,319 | 2/1914 | Forsyth | 49/63 X |
| 1,751,358 | 3/1930 | Rice et al. | 49/125 X |
| 2,108,000 | 2/1938 | Holt et al. | 49/406 X |
| 2,566,433 | 9/1951 | Thurman | 49/458 X |
| 2,895,182 | 7/1959 | Evans | 49/458 X |
| 2,908,051 | 10/1959 | Sparkes | 49/125 |
| 3,065,507 | 11/1962 | Cloutier et al. | 49/63 |
| 3,324,597 | 6/1967 | Rich | 49/458 X |

*Primary Examiner*—Philip C. Kannan
*Attorney, Agent, or Firm*—Norman S. Blodgett; Gerry A. Blodgett

[57] ABSTRACT

Window insulating apparatus consisting of a plurality of low thermal conductivity panels slideably carried in a conventional window frame.

8 Claims, 6 Drawing Figures

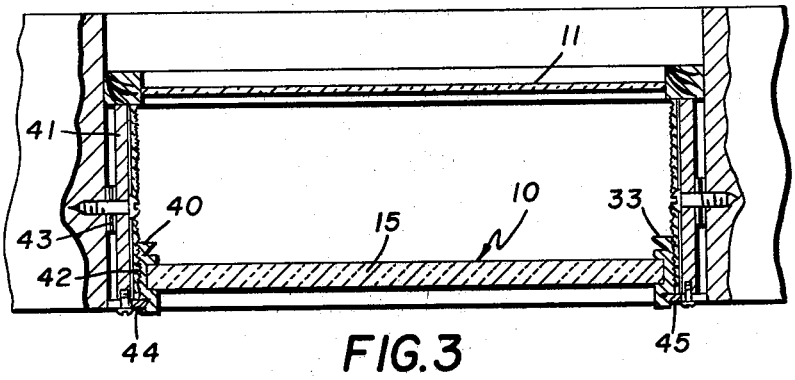
FIG.3
FIG.4
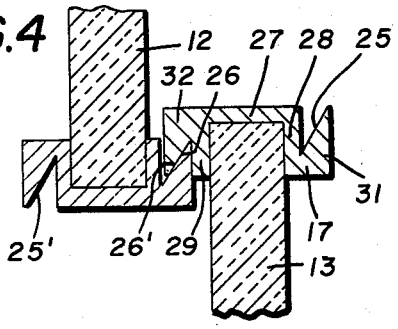
FIG.5
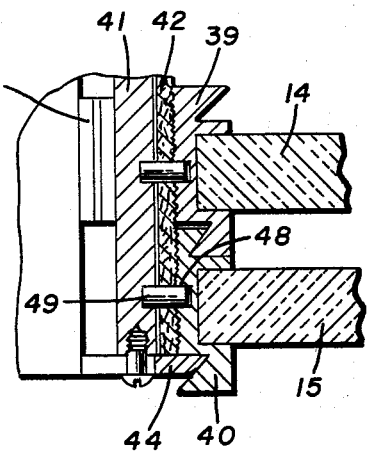
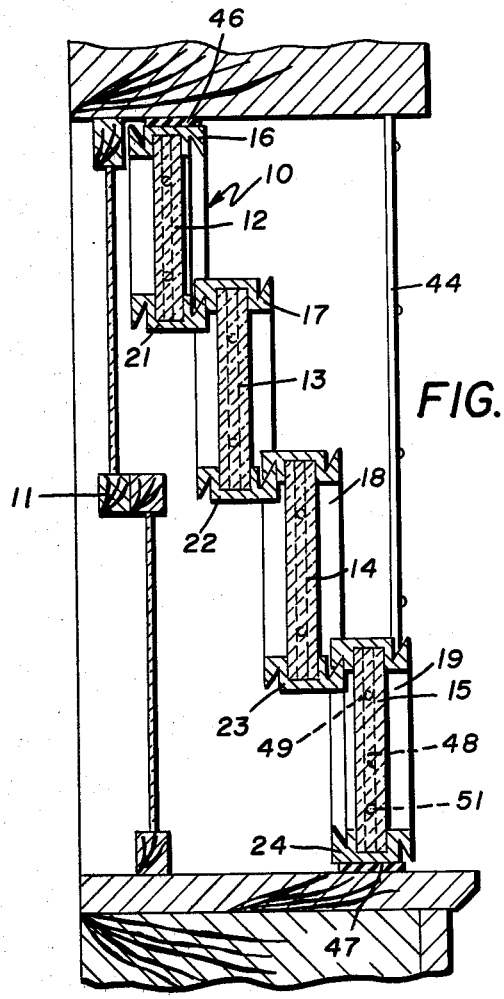
FIG.6

WINDOW INSULATING APPARATUS

BACKGROUND OF THE INVENTION

As the years go by and the price of fuel becomes higher and higher, it becomes more important that the heat loss by convection through the windows of buildings be reduced. This is particularly true in the case of residential buildings, where ther is a greater likelihood of the windows being ill-fitted and loose. In the past, it has been common practice to provide heavy, insulated drapes over large windows in homes, whereby a certain amount of radiant and convective heat loss is prevented. The ideal system is to have a dead air space between the interior and the exterior of the house in the window space. It has been a common but expensive practice to provide double-thickness glass in the lights of residential windows, but this still does not prevent leakage around the window and through cracks. While metal shades have the effect of reducing the radiation to and from a room (therefore preventing heat loss in the winter), they have little effect on convection loss. Various means, such as covering the interior of the window frame with a clear plastic-like film and cementing it in place suggest themselves, but most of these are either unsightly or are not easily removed and stored when it is desirable for aesthetic purposes and otherwise to expose the window. These and other difficulties experienced with the prior art devices have been obviated in a novel manner by the present invention.

It is, therefore, an outstanding object of the invention to provide window insulating apparatus which, when in use, provides excellent sealing against the loss of heat by convection through a window.

Another object of this invention is the provision of window insulating apparatus which, when in use, has a pleasing appearance and which, nevertheless, may be easily stored without removing it from the window.

A further object of the present invention is the provision of insulation apparatus which is inexpensive to manufacture and which may be easily applied by a homeowner to a window.

It is another object of the instant invention to provide a window insulation apparatus which is changeable from an operative position (in which it effectively substantially reduces convection heat loss through the window) to a stored position in which it has a pleasing appearance.

With these and other objects in view, as will be apparent to those skilled in the art, the invention resides in the combination of parts set forth in the specification and covered by the claims appended hereto.

SUMMARY OF THE INVENTION

In general, the present invention consists of a window insulation apparatus consisting of a plurality of panels formed of low heat-transfer material, the sum of the areas of the panels being approximately equal to that of the window opening. An extruded element is applied to the upper and lower edges of each panel, each element having a sealing surface which mates with a similar sealing surface on a similar extruded element applied to the immediately adjacent panel.

More specifically, each panel is generally rectangular and arranged with its length extending horizontally across the window. The panels are arranged in side-by-side vertical planes and are slideable vertically from a side-by-side storage position at the top of the window to an operative position in which the panels are arranged in a step fashion. A similar extruded element lies along each vertical edge of each panel, the sealing surface of each vertical extruded element engaging the similar sealing surface on the immediately adjacent vertical extruded element.

BRIEF DESCRIPTION OF THE DRAWINGS

The character of the invention, however, may be best understood by reference to one of its structural forms, as illustrated by the accompany drawings, in which:

FIG. 3 is a horizontal sectional view of the apparatus, taken on the line III—III of FIG. 2, FIG. 4 is a vertical sectional view of a portion of the invention taken on the line IV—IV of FIG. 2, FIG. 5 is a horizontal sectional view of the invention taken on the line V—V of FIG. 2, and FIG. 6 is a vertical sectional view of the invention taken on line VI—VI of FIG. 2.

DESCRIPTION OF THE PREFERRRED EMBODIMENT

Figure 1:
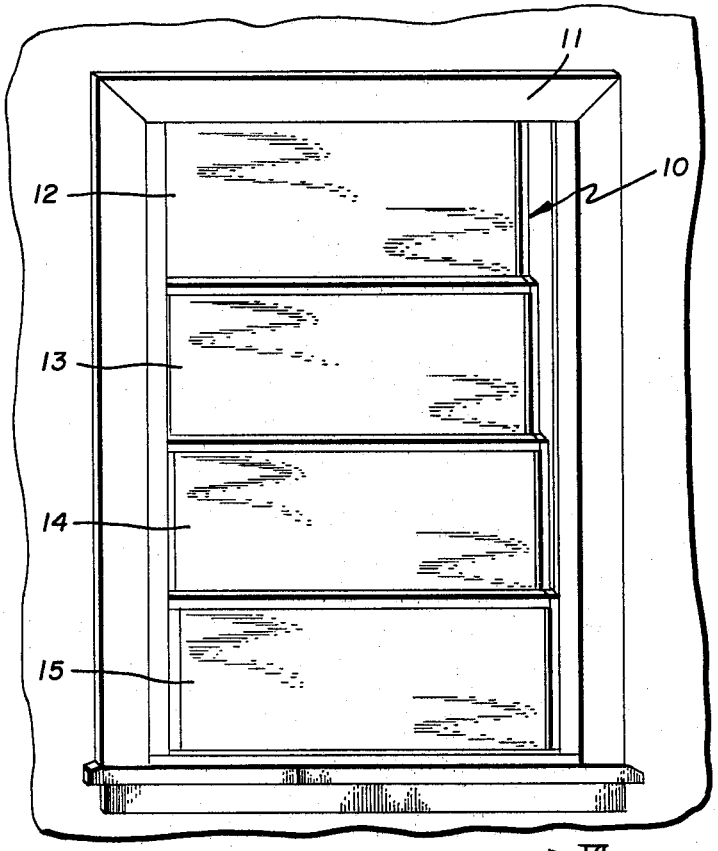
FIG. 1 is a perspective view of a window insulating apparatus embodying the principles of the present invention shown in use with a window.

Referring first to FIG. 1, in which are best shown the general features of the invention, the window insulating apparatus, indicated generally by the reference numeral 10, is shown in use with a conventional double-hung residential window 11. The apparatus is shown as consisting of four panels 12, 13, 14, and 15, the sum of whose areas is slightly more than the total area of the window opening. Each panel is generally rectangular in shape and is arranged with its long dimension extending horizontally. The panels are arranged in side-by-side planes and are slideable vertically in the window frame from an upper storage position (where the panels lie side-by-side) to a lower operative position (where the panels are raised in a steplike condition, as shown in the drawing).

Figure 2:
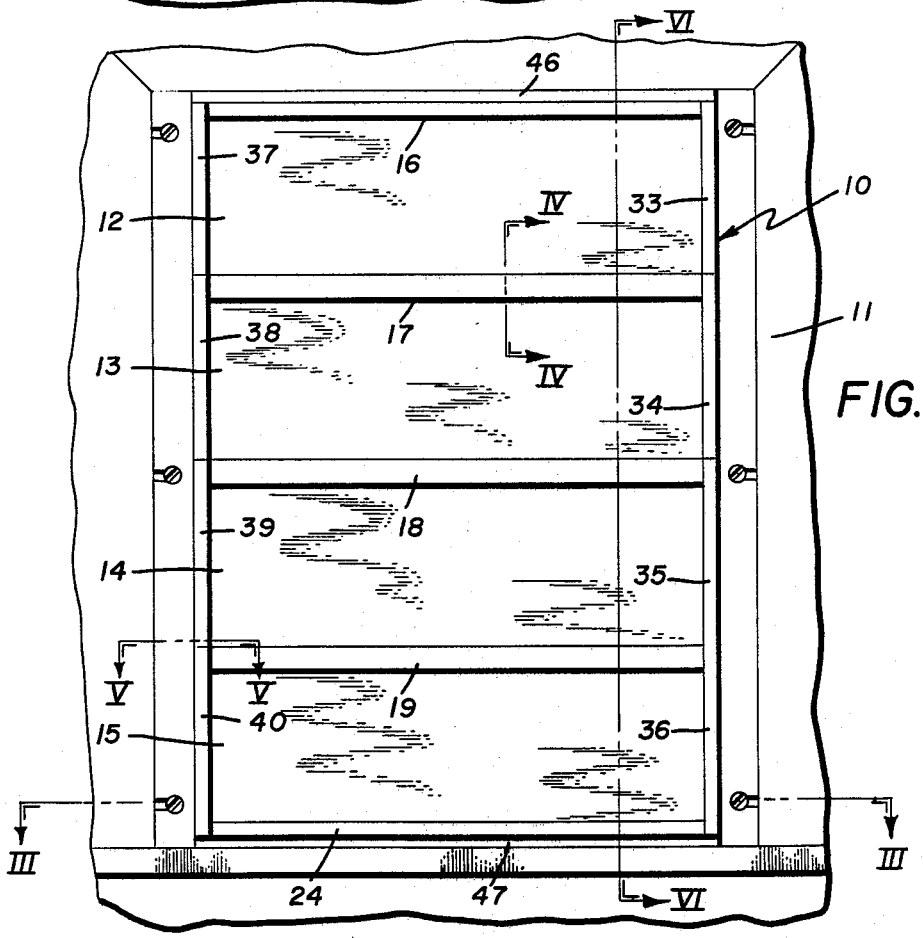
FIG. 2 is a front elevational view of the apparatus.

Referring to FIG. 2, it can be seen that the upper and lower edges of each panel are provided with an extruded element. The upper edge of the panel 12 is provided with the extruded element 16, the upper edge of the panel 13 is provided with the extruded element 17, the upper edge of the panel 14 is provided with the extruded element 18, and the upper edge of the panel 15 is provided with an extruded element 19. The extruded elements 21, 22, 23, and 24 on the lower edges of each of these panels are best shown in the FIG. 6.

Each vertical or side edge of each of the panels is provided with an extruded element also. For instance, the panel 12 is provided on one end with the extruded element 33 and at the other end with an extruded element 37. The panel 13 is provided at one end with the extruded element 34 and at the other end with an extruded element 38. The panel 14 is provided on one end with an extruded element 35 and at the other end with an extruded element 39. The panel 15 is provided on one end with an extruded element 36 and the other end with an extruded element 40.

An understanding of the shape of the horizontal extruded elements can be made by an examination of FIG. 4, which shows the area around the conjunction of panels 12 and 13. The extruded element 17 is typical of all of the horizontal extruded elements and is similar with one exception to the vertical extruded elements.

The extruded element 17 includes a horizontal wall 27 which rests against the edge surface of the upper edge of the panel 13. It is also provided with a flange wall 28 that rests against the inwardly-directed surface of the panel 13 adjacent the edge and with a spaced parallel flange wall 29 which lies against the outwardly-directed wall of the panel 13 adjacent the edge. The flange walls both extend at a right angle to the horizontal wall 27. Extending outwardly from the flange walls 28 and 29 are rails 31 and 32. The rail 31 carries an inclined sealing surface 25 which is inclined toward the flange wall 28 and forms with it a upwardly-directed V-shaped groove. In a similar manner, the rail 32 is formed with the inclined sealing surface 26 which combines with the outer wall of the flange wall 29 to form a downwardly-directed V-shaped groove. The vertical extruded members are formed with an exactly same cross-sectional shape, except that a groove is formed in the outer surface of the wall which corresponds to the horizontal wall 27 of the extruded element 17.

FIG. 3 shows the manner in which the sides of the apparatus are adjusted and sealed. A wooden plate is screwed to the side frame of the window and is provided with a covering 42 of nylon plush. A broad ribbon-like leaf spring 43 is inserted in the space between the rail of the window and the plate. The vertical extruded elements engage the plush to provide a good seal. The pressure of the leaf spring 43 assures that proper adjustment takes place. In order to cover the space between the plate 41 and the side frame of the window, a panel 44 is provided, which panel has horizontal slots permitting sliding adjustment on screws which attach it to the outer edge of the plate 41. The inner edge of this panel engages the sealing surface of the vertical extruded element 40 of the innermost panel 15.

FIG. 5 shows particularly well the manner in which the vertical extruded element mate to form a good seal. As shown in the drawings, the section is taken in the overlap area of the panel 14 with the panel 15. It shows how the extruded elements 39 and 40 inter-engage with their sealing surfaces in contact. It also shows the manner in which pegs 49 and 51 operating in grooves 48 on the vertical extruded elements serve to guide the panels in their up and down movement, this being in addition to the guiding provided by the panel 44. A foam pad 46 resides between the horizontal extruded element 16 and the upper horizontal portion of the window frame at the upper edge of the panel 12, while a similar foam pad 47 resides between the extruded element 24 at the bottom edge of the panel 15 and the window sill.

The operation of the invention will now be readily understood in view of the above description. In the drawings the panels are shown as in their operative position in which the passage of heat outwardly through the window is inhibited. In this position, as is evident in FIGS. 1 and 2, the panels 12, 13, 14, and 15 completely cover the window opening. When the weather is such that the heat saving features is not needed, the panels are moved up into a vertical position co-extensive with the panel 12 (which never moves), so that three-quarters of the window is available for the admission of light, the four panels occupying only the upper one-quarter.

As is evident in FIG. 6, when the panels are moved to their downward position, the sealing surfaces are in firm engagement. As is evident in FIG. 4, the sealing surface of the horizontal extruded element of the lower panel tightly engages the sealing surface of the lower extruded element of the upper panel. Along the sides of the panels the leaf springs 43 maintain the panels 41 with their plush covering 42 snugly pressed against the vertical extruded elements along the sides of the panels. The panels 44 and 45 assist in preventing passage of convection air through the space between the plates 41 and the side frame of the window.

The advantages of the present invention can be readily understood in view of the above description. The present invention involves an attachment for conventional windows which can be easily applied by a homeowner, or at least applied with a minimum of labor by the employees of the organization selling the apparatus. The device presents a pleasing appearance when in its upper stored position; most people use shades on windows and the shades are normally set at one-quarter distance at the upper part of the window in any case. In other words, it will give the appearance of a partially-drawn shade when in the storage position. When in the lower, operative position, of course, the surfaces of the panels can be decorated as appears to be necessary and even supplied with an imaginary scene of what might exist outside the window. In any case, in the operative lower position, the important criterion is the saving of heat and, particularly during the winter months, the outer appearance of the landscape is not as important as the saving heat and the expense of the fuel. The size of the extruded elements and the panels on which they are fitted can, of course, be varied to suit the particular climate involved. The thickness of the insulated panel may be greater in a colder climate, but, of course, this thickness is limited by the depth of the window casing available. Furthermore, the present design lends itself very readily to sale in "kit" form in which the homeowner can cut his panels to suit his particular window size and in which the standard extruded elements can easily be cut and cemented in place. The installation of the present invention will pay for itself in a very short time. It is a positively-working shade, it reduces air draft around the lower window tracks and joints, it traps dead air for insulation purposes, and the panels provide additional insulation. Particularly, when storm windows are not closed or are loose fitting, the present invention will slow down the heat loss on colder nights. it will help to retain sunny weather heat and it acts as an indoor temperature regulator, particularly in the springtime and in fall. Also, when the apparatus is in closed or operative position, it will tend to reduce outside noise. It will lower the cost of air conditioning, not only at nighttime, but in the daytime also when in operative position, because it will reflect a degree of radiant heat from the sun. It will prevent some of the heat from entering the room and will shade the room. It is the intent of the present invention to provide a durable, adjustable construction with a minimum of friction which is intended to last for a considerable period of time and to save on the cost of heating and air conditioning in such a manner as to pay for itself in a short time. It is an attempt to approach the heat transfer coefficient, k, of an insulated exterior wall when used with storm windows and ordinary inside windows, using double-hung single glass glazing. It contemplates an installation in 10 to 15 minutes by unskilled labor and it has various built-in features for wear adjustment. There is an adjustable friction face plate with adjustable side friction plates together with a nylon plush surface to permit adjustment for minor irregularities in window casing. It allows a soft, tough seal within the outside grooves at the vertical edges of the panel extrusions. The plush passes around the rear edge of the side friction plates and meets the lower window frame to give a seal at three edges. It contacts the lower window toward the outside of its track and allows the movement of the lower window without undue wear on the inside window frame surface. The cushioned edges of the weather seal foam at the top and the bottom allow a close-fit interlock to occur between the bottom and the top edges of the panels. The extruded elements around the edges of the panels provides a positive vertical tracking for all panels and allows a "light touch", even friction on the vertical interlocks between the panels when the four panels are cut to the same horizontal length. it provides frame strength to the insulating panel, which can therefore be composed of a non-rigid reinforced foam low density fiberboard or a moisture resistant paper board or polyurethane if desired. The extrusions allow for a snap lock or fitted hold with or without adhesive, depending on whether a plastic or an aluminum extrusion is used and on the physical nature of the panel. It provides an operating hold for the movement of the panels and it provides for a one-panel control operation on the other panels, except the top panel which is fixed in place. It provides an air seal betwen the panels when the bottom panel rests on the foam seal. It provides for a close-fit seal toward the ends of the vertical tracking grooves toward the bottom edges and the ends of each panel when the bottom panel touches the window sill. It provides for a no-snag guidance into the horizontal interlock because of the chamfered and angled fitting elements. An air seal at the edges of the panels is assured by the serrated or combed extrusion edge which slides in the plush fiber or bristle, while at the same time assisting in the track because of the compensation inherent in the fiber. At the same time, it permits a softer touch against the plush for reducing wear. An additional fit of an extrusion insert is allowed that will permit clear plastic or tinted or polyerized window sheeting. The four panels can be inserted or removed as a group in a few minutes once the screws are loosened on the face plates, if it is not desirable to use the panels during the summer. The three lower panels may be set at any vertical height, thus acting as a shade and the panels then have clearance between their surfaces.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Window insulating apparatus, comprising:

(a) a plurality of panels formed of low heat-transfer material, the sum of the areas of the panels being approximately equal to that of the window opening, each panel being generally rectangular and being arranged in the window opening with the length extending horizontally, the panels being arranged in side-by-side planes and slidable vertically from an upper storage position where the panels lie side-by-side to an operative position where the panels are arranged in a step-like condition, and (b) an extruded element applied to the upper and lower edges of each panel, each element having a sealing surface which mates with a similar sealing surface on an extruded element applied to the immediately adjacent panel, a similar extruded element extending along each vertical edge of each panel, the sealing surface on said similar extruded element of one panel engaging the sealing surface on said similar extruded element of the immediately adjacent panel, the engagement between the sealing surfaces of said similar extruded elements taking place along the entire length of said similar extruded elements when the panels are in the storage position and engaging along only a small portion of the length of the said similar extruded elements when the panels are in the operative position.

2. Window insulating apparatus as recited in claim 1, wherein a plate extends along and is spaced from each vertical side of the window and coated with plush which is engaged by the vertical extruded elements, and spring means is located in the space between each plate and its adjacent vertical frame.

3. Window insulating apparatus as recited in claim 2, wherein a narrow vertical panel is attached to the front edge of each plate, the panel being horizontally adjustable relative to its plate to cover the said space.

4. Window insulating apparatus as recited in claim 3, wherein a foam pad is located between the upper horizontal rail and the extruded element at the upper edge of the uppermost panel.

5. Window insulating apparatus as recited in claim 4, wherein a foam pad is located between the window sill and the extruded element at the lower edge of the lowermost panel.

6. Window insulating apparatus as recited in claim 5, wherein each of the vertical extruded elements is provided with a longitudinal groove, and wherein two vertically spaced pegs are mounted in each plate for engagement with the lastnamed groove of each of the vertical extruded elements.

7. Window insulating apparatus as recited in claim 1, wherein each extruded element includes a horizontal wall that lies along the edge surface of the panel, a first flange wall extending at a right angle to the horizontal wall along a face surface of the panel adjacent the edge surface, and a second flange wall extending at a right angle to the horizontal wall along the other face surface of the panel adjacent the edge surface.

8. Window insulating apparatus as recited in claim 7, wherein a rail extends outwardly from each flange wall and has an inwardly directed inclined surface, thus providing grooves between the inclined surfaces and the outer surface of each adjacent flange wall, one groove opening is one direction and the other groove facing in the other direction.

* * * * *